US006279910B1

(12) United States Patent
de Keller

(10) Patent No.: US 6,279,910 B1
(45) Date of Patent: Aug. 28, 2001

(54) METHOD FOR PLAYING A CASINO GAME

(76) Inventor: David Guy de Keller, Sweet Valley Farm, Soetvlei Ave., Constantia 7800, Cape Town (ZA)

( * ) Notice: Subject to any disclaimer, the term of this patent is extended or adjusted under 35 U.S.C. 154(b) by 0 days.

(21) Appl. No.: 09/316,705

(22) Filed: May 21, 1999

Related U.S. Application Data

(63) Continuation-in-part of application No. 09/239,175, filed on Jan. 28, 1999.

(51) Int. Cl.[7] ..... A63F 1/00
(52) U.S. Cl. ..... 273/292; 463/12
(58) Field of Search ..... 273/274, 236, 273/292, 303; 463/12, 13

(56) References Cited

U.S. PATENT DOCUMENTS 5,265,882 * 11/1993 Malek .
5,328,189 * 7/1994 Malek .
5,364,105 * 11/1994 Jones .
5,377,973 * 1/1995 Jones .
5,395,120 * 3/1995 Malek .
5,417,430 * 5/1995 Breeding .
5,482,289 * 1/1996 Weingardt .
5,577,731 * 11/1996 Jones .
5,876,283 * 3/1999 Parra .

OTHER PUBLICATIONS

P. 202–205 of "The way to Play" by the Diagram Group (1975).*

* cited by examiner

*Primary Examiner*—Benjamin H. Layno
*Assistant Examiner*—Vishu K Mendiratta
(74) *Attorney, Agent, or Firm*—Philip J. Anderson; Anderson & Morishita

(57) ABSTRACT

A modified method for playing card game such as Blackjack or Baccarat is set forth wherein the players each make a first wager to participate in the game and a second wager, the second wagers accumulated to form a pot. The pot, less any levy for the casino or to fund a jackpot, is awarded to the player according to the various embodiments thereof to the player(s) (i)having a final hand count closest to the target value for the game. A portion of the pot may be allocated to form a jackpot awarded to players based upon there obtaining a predetermined holding or players who lost the pot but have a predetermined hand card combination.

22 Claims, 3 Drawing Sheets

3 X 4'S SUITED = PROGRESSIVE JACKPOT

3 X 4'S UNSUITED = MINOR JACKPOT

2 X 4'S SUITED = $ 100

2 X 4'S UNSUITED = $ 50

METHOD FOR PLAYING A CASINO GAME

CROSS-REFERENCE TO RELATED APPLICATION

The present application is a Continuation-in-Part application of application Ser. No. 09/239,175 filed Jan. 28, 1999 by the applicant herein and titled "Method for Playing a Casino Game.

FIELD OF THE INVENTION

The present invention relates to methods for playing casino games using playing cards. More particularly it relates to Blackjack and Blackjack-like games as well a Baccarat.

BACKGROUND

Blackjack, also known as "21"is popular and has been played in casinos for many years. The rules of the game of Blackjack are well known to those skilled in the art.

The rules, with a few exceptions, are fairly universal. Some alternate rules of the basic Blackjack game require the dealer to hit a soft 17 (a hand count according to the rules of Blackjack of 17 including an Ace which counts as one or eleven), limit the hand counts to which a player can double down to ten or eleven, and limit the number of times a hand can be split are but a few examples. These alternate or modified rules are well known as well.

Recently, Blackjack-like games such as SPANISH 21® described in U.S. Pat. No. 5,615,888 issued Apr. 1, 1997 to Lofink et al the disclosure of which is hereby incorporated by reference, have been created. Some of these games include the feature of an additional or side wager to fund and participate in a jackpot feature for the game based upon the player's hand. In these games the side wager is optional and is not mandatory.

As hereinafter used, the term Blackjack or Blackjack-like or Blackjack-style game refers not only to the basic Blackjack game with its variations but also the aforementioned and other games which are like Blackjack.

Other variations include that described in Le Vasseur U.S. Pat. No. 5,257,789 where a player can play a single hand against multiple dealer's hands and String U.S. Pat. No 5,649,705 where a player can elect to wager upon whether the player or dealer will obtain a winning hand.

These Blackjack games are banked by the house (e.g. casino). This means that the player is playing against the dealer who represents the house. Wagers are paid to a player having a winning outcome by the dealer (the "house") and losing wagers are collected by the dealer for the house. Further nearly all winning outcomes are paid at even money, i.e. 1:1, except for a Blackjack (an Ace with a ten value card) which typically pays 3:2.

In contrast to Blackjack, the game of Poker and its variations is a contest between the players with the highest ranking hand winning the pooled wagers (often referred to as the "pot"), less a levy or "rake" taken by the house dealer for hosting the game. Unlike Blackjack the game of Poker generates social interplay in the form of friendly or not so friendly rivalry, humor, banter and byplay between the players which contributes to the excitement of the game. Furthermore, Poker provides exciting features including providing, in some establishments, what are referred to as "bad beat" jackpots. These jackpots are funded as a levy on the Poker pot and are won by a player who loses but has a predetermined holding, i.e. four-of-a-kind. Since games such as Blackjack and Baccarat do not have player versus player competition, there has been no consideration of providing bad beat jackpots in those games.

Baccarat is a game akin to Blackjack in that the house collects and pays all wagers, i.e. the player is playing against the house, and the object of the game is to obtain a final hand having a value, as determined by the rules of the game, closest to a target value. In Blackjack, the target value is 21 whereas in Baccarat the values are determined modulo ten and the target value is 9.

The rules of play of conventional Baccarat are well known including the complicated and cumbersome rules governing when a third card is dealt to either the Banker or the Player hands. Suffice it to say, players play the game by wagering that either the surrogate Banker hand or Player hand will have a total, modulo ten, closer to nine than the opposing hand. Players may also wager that the Banker and Player hand will have an equal total (a tie). In that the third card draw rules provide a statistical advantage to the Banker hand, the house exacts a commission upon winning Banker hand wagers of typically five percent. No commission is exacted upon winning Player hand wagers. As stated above, the rules of Baccarat are well known in the art.

A drawback of conventional Baccarat is that the house must keep track of and assess commissions on winning, Banker hand, wagers. A further drawback is that the third card draw rules are complex and difficult for novice players to understand. The third card draw rules are strict leaving the players with no opportunity to use strategy or hunches to opt to obtain or not obtain a third card. Yet another drawback is that the players play to the surrogate Banker or Player hands and thus cannot rely on their own individual luck. Further, in conventional Baccarat the players have only one opportunity to receive a payoff, e.g. a winning wager on one of the Banker or Player hands or winning the tie bet. It would be advantageous to provide players with opportunities to receive a payoff even if they do not win the Banker-Player contest or the tie wager.

It is an object of the method of the present invention to inject the excitement associated with Poker into the game of Blackjack or Baccarat.

It is a further object of the method of the present invention to increase the revenue received by the casino for Blackjack or Baccarat.

It is further an object to provide the players with additional opportunities to receive a payoff while playing the game.

It is another object to provide a variation to the game of Baccarat which enables each player to play their own, individual hands and which dispenses with the complicated third card draw rules of conventional Baccarat as well as commissions.

It is another object to provide a game having the above features which can be adapted to include a bad beat jackpot.

SUMMARY OF THE INVENTION

There is provided, therefore, according to the present invention an improved method for playing a modified casino game of type wherein each player makes a first wager to participate in the game such as a game which has basic play rules akin to Blackjack or Baccarat (Baccarat, Chemin de Fer). Each player and the dealer are dealt a hand of cards the values of which are summed according to the rules of the game. In a Blackjack-style game, the cards are summed with picture cards, i.e. Jacks, Queens and Kings, having a value of ten, Aces having a value of one or eleven and all other cards having a their face value. For a Baccarat-style game, the picture cards have a value of zero, Aces a value of one, the other cards have their face values and the cards are summed modulo ten. The player's first wager is won or lost in comparison to the dealer's hand. As between the player and dealer, the hand with the highest summed value closest to a target value (21 for Blackjack and 9 for Baccarat) is declared the winner with ties deemed pushes. If the player is the winner, he is paid usually 1:1 based upon his first wager. If the dealer is the winner, the player's first wager is collected. The method of the present invention includes each player making a second wager, the second wagers aggregated to form a pot. The player at the game with the highest value hand as between the players closest to the target value is awarded at least a portion of the pot. Players having the same, highest values, share in the award. A levy may be assessed on the pot and used to fund a jackpot paid to players having a predetermined hand card combination. Further the levy may be used to fund an alternate or additional bad beat jackpot awarded to a player who loses the pot and who has predetermined holding of cards.

Where the game is a Blackjack-style game where the players, in addition to their normal first or ante wager to play a hand of Blackjack, each make the second wager. The second wagers are aggregated to form the pot. At the conclusion of the Blackjack hand resolved according to the rules thereof, the dealer compares, for all players remaining in the hand, all players' hand outcomes to determine which players' outcome hand(s) are closest to 21. If all players have previously "busted" by exceeding 21 the pot is carried over. For the player having a final outcome hand count at or closest to 21, he/she is awarded the pot. If two or more players tie for the pot, the pot is shared pro rata.

For a Baccarat-style game, each player makes a wager on one of the dealer's (Banker) hand or his own player's hand which he plays against that of the dealer. The player's first wagers are won or lost by comparing each player's hand value, summed modulo ten, against that of the dealer. Each player and the dealer are initially dealt two cards and may take a third card to improve their hand value. If the player's or dealer's first two cards have a value of 7, 8 or 9 the player, draw of a third card may be precluded. If the player (or dealer) takes a third card, that card's value is summed modulo ten with the first two cards to arrive at a final hand value. The first wager is resolved by comparing the player's final hand value to that of the dealer's, with the highest valued hand closest to the target value of 9, declared the winner. If the player has wagered upon the winning hand, he wins with respect to his first wager. Where the Banker hand has the same value as the Player hand a tie occurs and the player neither wins or loses his first wager. To provide a vigourish to the casino, certain ties may be declared losses for the player's first wager, such as ties at 1 or 2. Players may also make tie wagers, as is provided in conventional Baccarat. To provide additional revenue to the casino the casino may exact a rake on the pot such as 1%, one dollar or the like.

As but a further feature a portion of each pot may be allocated to form a progressive jackpot awarded to a player having a predetermined final hand outcome and/or a bad beat jackpot.

As can be appreciated, by providing for the making of a second wager, the element of competition of Poker is injected into a Blackjack-style or Baccarat-style game. Further a player may lose their hand of the base game but win the pot or vice versa, also increasing the excitement of the game. Also the pot can be used to increase the revenue for the table by exacting a levy or rake on each pot and by using the pot to fund a progressive jackpot. Where a jackpot is used, a player may win and lose any combination of the base game, the pot or the jackpot. Where a bad beat jackpot is provided, a player could lose his first and second wagers and still receive a payment based upon a bad beat. This increases the excitement for the game.

BRIEF DESCRIPTION OF THE DRAWINGS

These and other features and advantages of the present invention will become appreciated as the same becomes better understood with reference to the specification, claims and drawings wherein:

DESCRIPTION

Broadly, the present invention is directed to a base game where each player makes a wager and playing cards are dealt and summed according to the rules of the game. In one aspect the game is applicable to Blackjack-style game and in another aspect to Baccarat style games. The variations will hereinafter be separately described.

Blackjack-style Games.

The present invention comprises a method for playing such a Blackjack-type wagering game which utilizes at least one deck of playing cards. While the present Blackjack-type wagering game will be described for use at a gaming table with one or more players, it should be noted that the game can be adapted to be played on an electronic or video gaming machine with multiple player stations all playing against a single dealer and all players competing between one another for a pot of pooled wagers.

Figure 1:
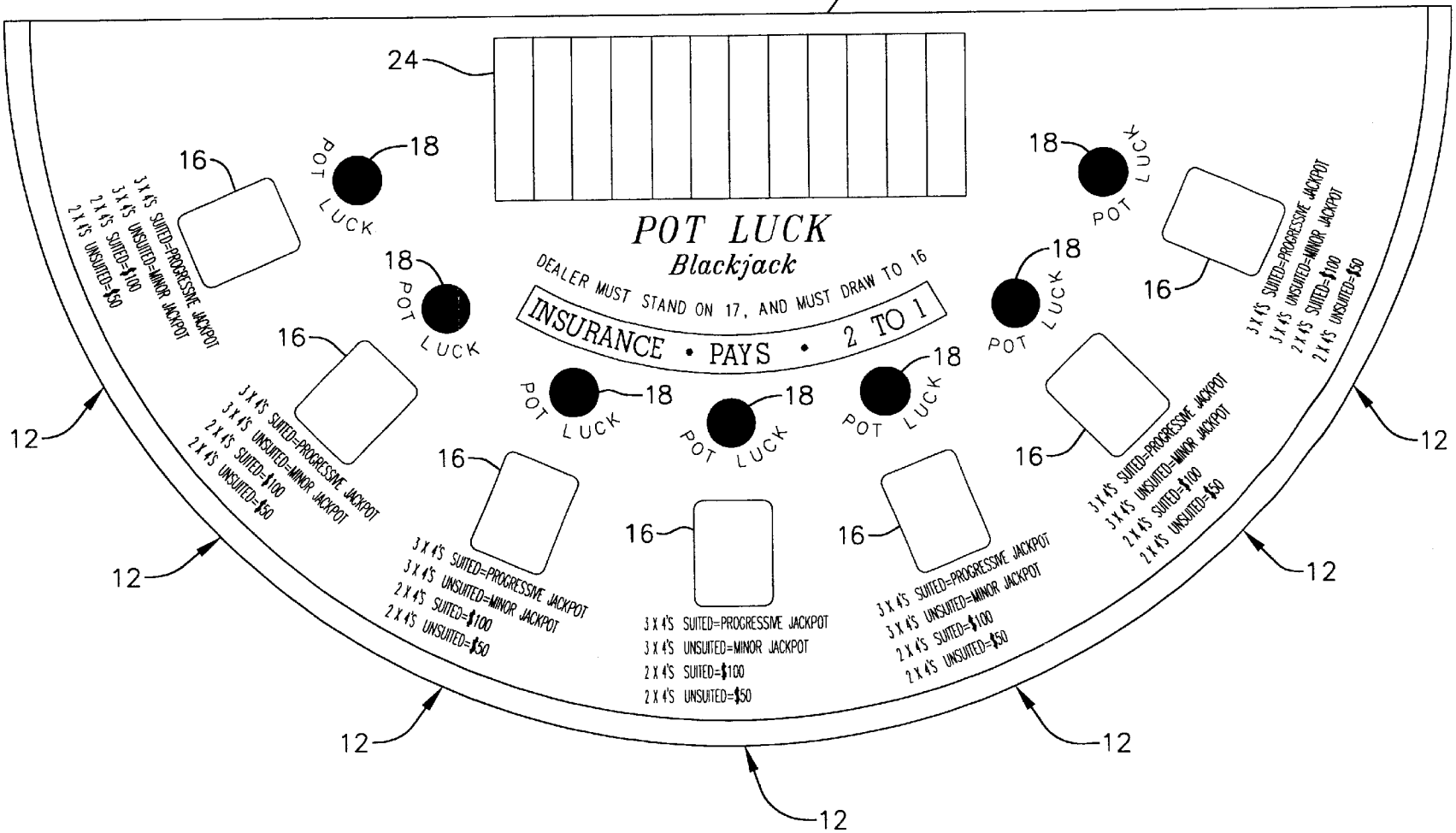
FIG. 1 shows an example of a layout for the play of a Blackjack-style game according to the present method.

Referring to FIG. 1, a table layout 10, upon which the modified Blackjack game of the present invention is played, is schematically shown. The layout is preferably mounted on top of a conventional type gaming table (not shown). A plurality of playing locations 12 are provided along the periphery of the table. Typically, there are seven playing locations. Each of the playing locations has the following designated areas associated therewith shown as betting areas 16 and 18. A dealer's location 22 is provided and has a chip rack 24 to contain the chips paid and collected during the play of the game.

A round of the modified Blackjack game of the present invention is begun by each player placing first and second wagers, the first wager placed in the betting area 16 and the second wager in the betting area 18 respectively. The wager on the betting area 16 constitutes the traditional wager associated with the game of Blackjack, namely, a house banked contest between each player's hand and the dealer's hand. The wager on the betting area 18 constitutes a feature found in the modified method of play of the present invention, namely, the pot bet.

The second wagers placed on the betting area 18 have no connection to the outcome of the dealer's hand.

The second wagers placed in areas 18 may be combined by the dealer into a pot accumulated at the center of the table.

Once the players have placed their first and second wagers the dealer deals two cards to each of the players and to the dealer. The round or hand of Blackjack then proceeds in a manner known in the art and according to the rules of the game. After the initial deal, the dealer first settles with each player separately with regard to their wagers on the betting areas 16. Each player in turn, may either "stand" (on his first two cards, or at any later time), or may request additional card(s). A player may continue to draw additional cards, but once he stands he may draw no more cards. All additional cards received by the player are usually dealt face up. If an additional card puts the player's hand count over 21, he must show his cards and the dealer collects his first and second wagers. This player has busted and is no longer in the hand. When every player, except the dealer, has either completed their hand to a final holding represent a final count not exceeding twenty-one or busted and dropped from the hand, the dealer turns up his face-down card. Casino rules may specify that the dealer must take additional cards as long as his total is 16 or less and must stand when his total reaches 17 or more. If the dealer goes over 21 he loses the hand and pays each player remaining in the hand. When the dealer completes his hand, he collects from each player having a lower count, pays each player having a higher count, and has a stand-off (push or draw) with each player having the same count.

Under the rules of Blackjack, a player has the option regarding his wager on the betting area 16, if his first two cards are a pair, such as two sevens or two Jacks, to play them as two different hands. When the player who 'split' turn comes, he turns both cards face up and places another wager in the amount of his first wager on betting area 16 and an additional second wager in area 18 for each split hand. The player then plays and completes each of his hands separately.

All of the conventional features of the Blackjack-style game as they apply to the wager on the betting area 16 may be utilized by the player in the method of the present invention. A player may 'double down' and take 'insurance' on his hand as the conventional manner of play according to what the rules will permit.

Having settled all bets in relation to the first wagers placed in the betting areas 16 for Blackjack the dealer then once again examines each player's hand in relation to the second wagers. Those players who busted are no longer in the hand and do not qualify for the pot accumulated from the second wagers. Players that 'split' their cards into two hands qualify for the pot/pooled wagers in terms of both hands. Alternatively, only one of the hands, e.g. the first hand qualifies for the pot/pooled wagered. The dealer determines which player(s) has a count of 21 or alternatively which of the players has the highest count closest to 21 and awards all the aggregated second wagers representing the pot to such player less a levy or vigorish (often referred to as a "rake"). In the event of two or more players hold the highest count, the pot is shared on an equal basis. In the event of all players 'busting,' having a total in excess of 21, a levy is deducted from the winnings and the remainder of the winnings are carried forward to the next hand.

In a preferred embodiment of the modified method of playing the game, the second wagers placed in the betting areas 18 are combined with a jackpot feature. The jackpot paytable is comprised of a series of ranked hands with an ascending order of fixed odds or alternatively the jackpot will be a progressive jackpot. In the latter case the major jackpot will be represented by the current total displayed on a win meter and the minor jackpots a combination of a percentage of the major jackpot total and fixed amounts. The betting areas 18 are drawn onto the playing surface/layout 10 or may be defined by sensors which are either magnetic, or fitted with optical eyes or capacitors to determine the placing of wagers. When the second wagers are combined with a jackpot feature a portion is deducted from the pot winnings to fund the jackpot. Table A as illustrated below is a specimen paytable of a jackpot feature to be combined with the pot bets in the betting areas 18.

TABLE A

| | |
|---|---|
| Three suited 4s | Progressive Jackpot |
| Three unsuited 4s | 50% of Jackpot |
| Two suited 4s | 25% of Jackpot |
| Two unsuited 4s | 10% of Jackpot |

Alternatively, the awards could be fixed amounts such as suggested in Table B below.

TABLE B

| | |
|---|---|
| Three suited 4s | $15,000 |
| Three unsuited 4s | $10,000 |
| Two suited 4s | $5000 |
| Two unsuited 4s | $500 |

Figure 2:
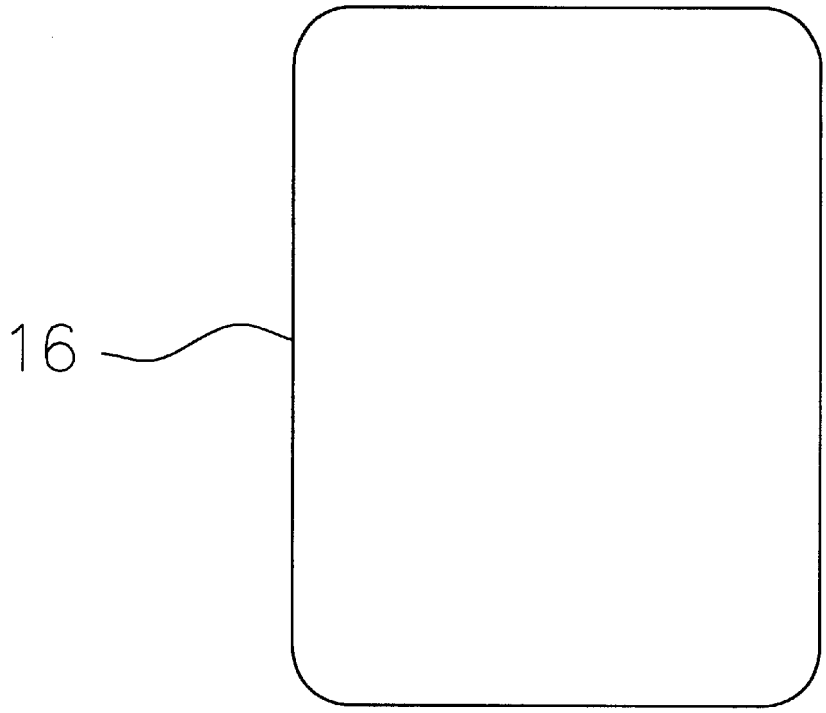
FIG. 2 shows an enlarged vied of one of the player's betting areas of FIG. 1 with certain payoffs listed therefor.

FIG. 2 illustrates an enlarged view of the betting area 16 which may have indicated adjacent thereto the various jackpot combinations and the payoffs for each, A player remaining in the hand (he has not previously busted) who has a predetermined jackpot holding such as those set forth in Table A is awarded the corresponding jackpot regardless of whether or not he wins the Blackjack first wager or the pot bet. All wagers and awards are separately determined. In accordance with the method of the present invention a player may lose both first and second wagers yet qualify for a payout on the jackpot feature.

It is to be understood that the jackpot holdings and payouts of Tables A and B are suggestive only in that the casino may adopt different holdings and payouts.

As a further embodiment, the second wagers accumulated to form the pot could be awarded based upon (i) the highest count of the first two cards or (ii) the player(s) having a Blackjack.

As yet a further embodiment, a separate jackpot wager could be made in addition to the first and second wagers. Thus a player, under this embodiment, would be required to make a first wager to participate in the basic Blackjack game, a second wager to form the inter-player pot and a separate jackpot wager directed to the jackpot component of the game. The levy or rake for the casino could be taken from the separate jackpot wagers thus leaving the accumulated pot as the aggregation of the second wagers. To accommodate the three separate wagers, three areas would be denoted on the layout therefor.

As a further feature a bad beat jackpot may be provided. A levy would be assessed on each aggregate pot or the side wager (if provided) to progressively fund a bad beat jackpot. If a player loses the pot to a player having a higher value hand and the losing player has a predetermined holding of cards, that player would be awarded at least a portion of the jackpot. Additionally the player having the higher valued hand may be awarded a portion of the jackpot as well as awarding a portion of the jackpot to the other players at the table.

As but an example, a bad beat jackpot may be provided where the pot winning player has a non-suited Ace-10 and the losing player has a hand of 10-10 of Spades. In this occurrence, the losing player would be awarded 50% of the assembled bad beat jackpot, the winning player with the non-suited A-10 awarded 25% of the jackpot and the other players playing that hand at the table awarded on a pro rata basis the remaining 25% of the jackpot. Other combinations may be provided for a bad beat award as well as providing a different schedule of payouts.

Baccarat-style Games.

Figure 3:
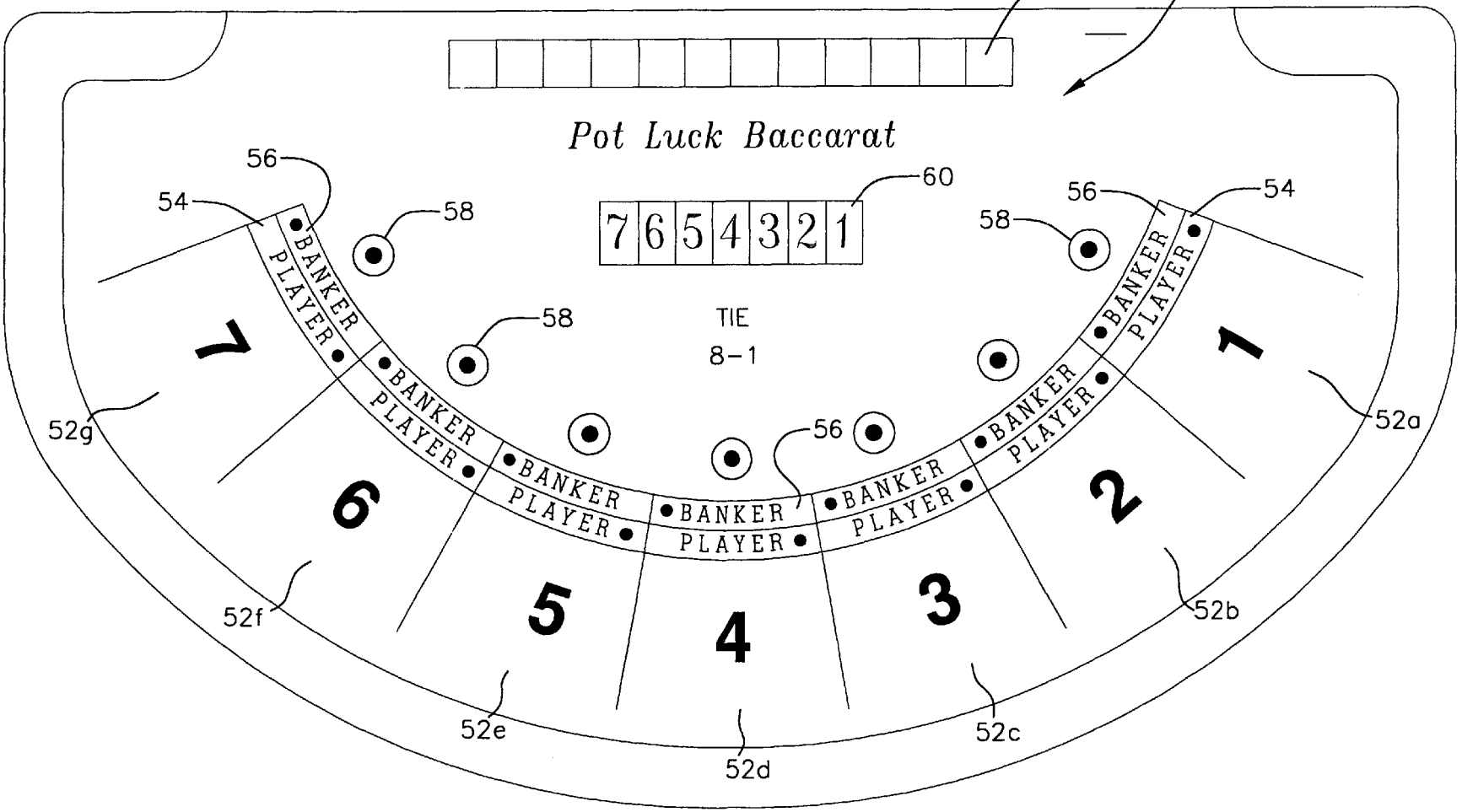
FIG. 3 shows an example of a layout for the play of a Baccarat-style game according to the present invention.

With reference to FIG. 3 the method of the present invention will be described in connection with a Baccarat-style game. While the present method will be described for use at a gaming table with one or more players, it should be noted that the game can be adapted to be played on an electronic or video gaming machine with multiple player stations all playing against a single dealer and all players competing between one another for a pot of pooled wagers.

To play the game each player makes a first ante wager on either a Player hand or a Banker hand to be presented during play of the game. For this purpose, a layout 50 may be provided including a plurality or, for example seven, player positions 52*a–g*. At each position 52*a–g* there is provided a number of wagering areas adapted to accept wagers made by the player. A Player area 54 is provided at each position 52*a–g* in which the player may place the first ante wager to indicate that he is wagering upon the Player hand controlled by the player. Similarly there is a Banker area 56 in which a player may place their first ante wager to indicate that the player is wagering upon the Banker hand controlled by the dealer. Also each position 52*a–g* has associated therewith a pot wager area 58 in which the player places their second ante, or pot, wager according to the present invention. The pot wager area 58 may include sensors to register acceptance of the mandatory pot wager by each player. Also provided on the layout is a tie wager area 60 denoting each player position 52*a–g* as by being numbered one through seven. A check rack 24 is provided to contain chips used during the play of the game.

To play the game according to this embodiment, each player places their first ante wager in one of the Player or Banker areas 54,56 to signify which hand the player is wagering upon. The amount wagered may be dictated by table minimums or maximums. The player is also required to place a second ante (pot) wager in the pot wager area 58. The amount of the second ante wager may also be dictated by table minimums or maximums and the amounts wagered by the players as their second ante wagers will typically be the same for each player, e.g. five dollars. After the players have made their second ante wagers, the wagers are collected into a pot on the table. Each player also has the option, should they so desire, to place a tie bet by passing the amount of the tie wager to the dealer who places the tie wager in the corresponding player position in the tie wager area 60. Thus if the player at position 7 places a tie wager, that wager would be placed in the position denoted as "7" in the tie wager area 60 to signify this wager.

After the players have each made their first and second ante wagers and any optional tie wager, the dealer for the game deals two cards to each player as that player's Player hand and two cards in the middle of the layout 50 designated as the Banker hand. The cards are typically dealt from a shoe containing a plurality of standard decks of playing cards as, for example, six decks. The player Hand cards may be dealt face up with none, both or one of the Dealer's hand cards dealt face up. Each player values the cards of their hand, modulo ten, according to the rules of conventional Baccarat. Alternatively the face cards can have a value of ten and Aces count as one or eleven which, because the hands are summed modulo ten, will obtain the same hand valuations as in conventional Baccarat. The dealer also examines the value of the initial two cards of the Banker hand. If the value is eight or nine, the dealer exposes the Banker hand and the players may not draw any third cards to their hands and all wagers are resolved as described below.

If the Banker's hand does not have a two card value of 8 or 9, the player's assess their Player's hands. If the Player's hand value is 0–6, a third card is dealt to the Player hand. Alternatively, the player may opt to receive a third card. If the Player's hand has a value of 7–9, no third card may be received and the two card value is the Player hand final value. If a third card is dealt or the player opts to take a third card, that card's value is added to the two initial cards, modulo ten, to obtain a final Player hand value. After all player's have completed their respective Player hands, the dealer exposes the Banker hand. If the value of the Banker's hand is 7–9, the dealer may not deal a third card to the Banker hand and the two card values becomes the final Banker hand value. If the Banker hand initial two cards have a value of 0–6, the dealer deals a third card to the Banker hand, the value of which is added to the initial two cards (modulo ten) to arrive at a final Banker hand value. Thus the third card draw rules are easy to understand and symmetrical with respect to the Banker and Player hands. In one embodiment, where either a Player hand or the Banker hand has an initial value of 0–6, draw of a third card is required. In another embodiment, the player is provided with the option of drawing or not drawing a third card. It is to be understood that these third card draw rules may be modified to only be in effect when the initial values of the hands are 0–5.

In still a further embodiment, rather than applying the third card draw rules at all times to the Banker hand, where any Player hand has an initial value of 8 or 9 (a Natural in Baccarat), the Banker as to this Player hand value is precluded from drawing a third card. Thus if a Player hand has an initial value of 8 or 9, the dealer when he first exposes the Banker hand of the initial two cards would resolve that Player hand before drawing any third cards if required. After resolution of any Natural Player hand(s), the dealer would deal a third card to the Banker hand if required and thereafter resolve the remaining Player hands.

Each player's first wager is resolved in order by comparing the Banker's hand final value to each of the player's individual Player hand values. If the Banker hand has a higher value than that player's Player hand, e.g. is closer to the target value of 9, the highest value which can be obtained, the Banker hand is the winner. Conversely if the player's Player hand has a higher final value than that of the Banker, the Player hand is the winner. Hands of the same values are ties.

Once as to each player it is determined which of the Player or Banker hands is the winner (or a tie occurs), the dealer determines which hand the player wagered upon with his first wager. If a player has wagered upon the Banker hand and the Banker hand is the winner that player is paid 1:1 based upon his first wager. If the player has wagered upon the Banker hand and the Player hand is the winner, the player loses his first wager. Conversely, if the player has wagered upon the Player hand and the Player hand is the winner the player is paid 1:1 for his first wager. If the player has wagered upon the Player hand and the Banker hand is the winner, the player loses his first wager. If for any player his Player hand ties with the Banker hand, there is no action regarding the player's first ante wager, i.e. the first wager is neither won not lost. If the tying player has made a tie wager, the player wins the tie wager and is paid 8:1 on the tie wager.

Regarding ties, to provide a vigourish to the casino, certain tie wagers may be deemed losers. For example, ties at 1 or 2 would be declared losers for the player's first ante wagers regardless of whether they wagered upon the Banker or the Player hand. This provides the casino with a vigourish for the basic game of about 1.18%. Other losing tie value(s) may be selected. By making a tie wager a player may insure winning even in the event of a tie at a losing value.

After the players' first ante wagers have been decided, collected and paid, the second ante wagers are resolved. The aggregated pot of the second ante wagers is paid to the player or players having the highest Player hand values. For example, if the highest Player hand value is 6, that player would be awarded the pot regardless of whether or not the player won his first ante wager. The awarding of the pot is independent of whether or not the player wins the first ante wager thereby giving the player an opportunity to win even though he lost his first ante wager.

If desired, the aggregated pot may be assessed a levy of 1% or the like to provide additional revenue to the casino.

The pot may be assessed a levy to fund a progressive jackpot payable to any player having a predetermined Player hand holding. The jackpot or a portion of which may be awarded, for example, to any player having a Player hand with any one of the following holdings, again regardless of whether or not the player has won the first ante wager or the second ante wager aggregate pot, Jackpot Holdings
- Three 3s
- Three 3s (same suit)
- Three 3s (spades)
- Three of a Kind
- Three of a Kind (same suit)
- Three of a Kind (spades)
- Ace, Ace, 7 (same suit)
- Ace, Ace 7 (spades)

Other jackpot holdings may be provided. If a player has a Player hand with a jackpot holding, he would be paid the corresponding jackpot payoff represented by a fixed amount or a percentage of the pot funded aggregate jackpot.

Additionally or alternatively a levy may be assessed on each pot to fund a bad beat jackpot. As but an example, a bad beat jackpot could be awarded where a player having a Player hand of a first ranking loses the pot to a player having a Player hand with a second ranking. For example, the second ranking may be preselected as a two card Natural (a hand value of 9) of an unsuited 3 and 6 and the losing player second ranking is a two card hand of two 9s of Spades. In that event, the losing player would be awarded 50% of the progressively accumulated bad beat jackpot, the winning player 25% and all other players at the table who had participated in the round of play 25% of the jackpot on a pro rata basis.

Like the Blackjack game described above, the jackpots for the Baccarat-style game may be funded by a separate, third, side wager such that a jackpot levy need not be assessed against the aggregated second ante wager pot.

While the games described above have been described for play in a live table game format it is to be understood that the method could also be practiced in an electronic, slot machine or novelty game format as well with each player playing at a computer monitor against other players and a computer generated dealer hand. The game may be played electronically by a single player against a Banker hand; however, there would be no aggregated pot and no bad beat feature. Jackpot Player hand holdings could be provided and funded as a levy upon the player's wager or by an additional wager.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim as follows:

1. A method for playing a modified casino card game wherein each player makes a first ante wager to participate in the game, each player and a dealer is dealt a hand of cards the values of which are summed according to the rules of the game, the player's first ante wager resolved by comparing a player's hand value with the hand value of the dealer and determining which hand is closest to a target value, the method comprising:

the players each making a mandatory, second, ante wager, said second wagers aggregated to form a pot;

comparing all player' hand values to determine which player' hand value is closest to the target value and declaring the player(s) with the closest values the winners; and awarding the pot to the winner(s).

2. The method of claim 1 further including removing a levy amount prior to awarding the pot.

3. The method of claim 1 further including allocating a portion of the pot to a jackpot and awarding at least a portion of the jackpot to a player having a predetermined hand card combination.

4. The method of claim 3 further including awarding the jackpot to a player having one of a predetermined schedule of hand card combinations.

5. The method of claim 3 including awarding at least a portion of the jackpot to a non-winning player having a predetermined hand card combination.

6. The method of claim 5 where the game is a Blackjack-style game including awarding said portion to the player having a two card hand of two 10s of Spades.

7. The method of claim 5 where the game is a Baccarat-style game including awarding said portion to the player having a two card hand to two 9s of Spades.

8. The method for playing an improved game of Baccarat between a plurality of players and a dealer and where Aces have a value of one, face cards each have a value of ten and the remaining cards have their face value, the method comprising:

each player placing an first ante wager on one of a Player hand and a Banker hand and a mandatory second ante wager;

assembling the second ante wagers to form a pot;

dealing at least two playing cards to each player and to a Banker hand;

the players and dealer summing the values of their cards modulo ten to obtain for each player a Player hand value and a Banker hand value;

resolving each player's outcome wager by, (i) if the player has wagered upon the Player hand and player's Player hand value exceeds the Banker's hand value paying the player at least even money on his first ante wager, if the player has wager upon the Player hand and the Banker hand value exceeds the Player hand value, the player losing his first ante wager, (ii) if the player has wagered upon the Banker's hand and the Banker's hand value exceeds the player's Player hand value, paying the player based upon his first ante wager, if the player has wagered upon the Banker hand and the player's Player hand value is greater than the Banker's, the player losing his ante wager, and (iii) if the player's and dealer's hand have the same value, declaring the outcome a tie, and resolving the pot wagers by comparing the values of the player' hands and awarding the pot to the player(s) having the Player hand values closest to 9.

9. The method of claim 8 including initially dealing two cards to each player and the Banker, each assessing their two card hand values and, if desired, receiving a third card.

10. The method of claim 9 including if the Player or Banker hand has a predetermined initial two card value, dealing a third card to the hand.

11. The method of claim 10 including if the Player hand has a predetermined initial two card value providing the player with the option of receiving a third card.

12. The method of claim 9 wherein if any Player hand has a two card hand value of 7, 8 or 9 precluding the player from taking a third card.

13. The method of claim 9 wherein if the Banker hand has a two card hand value of 7, 8 or 9 precluding the Banker hand from obtaining a third card.

14. The method of claim 9 wherein if the Banker hand has a two card value of 8 or nine, precluding the players from receiving a third card.

15. The method of claim 8 including each player before receiving the cards placing a tie wager, if the player's hand and the dealer's hand values are equal paying the player based upon their tie wager otherwise the player losing their tie wager.

16. The method of claim 8 including designating at least one tie outcome as a losing tie outcome whereby if the Player hand and Banker hands tie, the player losing their first wager.

17. The method of claim 16 including designating ties of 1 or 2 as losing tie outcomes.

18. The method of claim 8 including funding a jackpot by assessing a levy upon the aggregate pot and paying any player hand having a jackpot outcome card combination at least a portion of said jackpot.

19. The method of claim 18 including designating at least a player hand of three 3's as a jackpot outcome.

20. The method of claim 18 including designating at least one of the following outcomes as jackpot outcomes, Three 3s Three 3s of the same suit Three 3s of spades Three cards of the same rank Three cards of the same suit and rank Three spades of the same rank Ace, Ace and 7 of any suit Ace, Ace and 7 of spades.

21. The method of claim 8 further including assessing a levy on the aggregated pot to fund the play of the game.

22. The method of claim 8 further including assessing a levy on the aggregated pot to fund a bad beat jackpot awarded to a player losing the pot and having a hand of a first ranking to a player winning the pot having a hand of a second ranking.

* * * * *